US010672540B2

(12) United States Patent
Yabuoshi

(10) Patent No.: US 10,672,540 B2
(45) Date of Patent: Jun. 2, 2020

(54) MANUFACTURING METHOD OF INSULATED WIRE FOR ELECTROMAGNETIC FORMING

(71) Applicant: TOYOTA JIDOSHA KABUSHIKI KAISHA, Aichi-ken (JP)

(72) Inventor: Masahito Yabuoshi, Chiryu (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 16/296,224

(22) Filed: Mar. 8, 2019

(65) Prior Publication Data

US 2019/0279791 A1 Sep. 12, 2019

(30) Foreign Application Priority Data

Mar. 9, 2018 (JP) ..... 2018-043387

(51) Int. Cl.

| | |
|---|---|
| ***H01B 13/00*** | (2006.01) |
| ***H01B 13/08*** | (2006.01) |
| ***H01F 41/08*** | (2006.01) |
| ***H01F 41/12*** | (2006.01) |
| ***H01F 5/06*** | (2006.01) |
| ***H01F 41/068*** | (2016.01) |

(52) U.S. Cl.

CPC ..... *H01B 13/08* (2013.01); *H01F 5/06* (2013.01); *H01F 41/068* (2016.01); *H01F 41/08* (2013.01); *H01F 41/12* (2013.01)

(58) Field of Classification Search

CPC ..... H01B 13/08; H01F 41/063; H01F 41/066; H01F 41/12; H01F 5/06

See application file for complete search history.

(56) References Cited

U.S. PATENT DOCUMENTS

| | | | | |
|---|---|---|---|---|
| 3,617,617 | A * | 11/1971 | Katz | H01B 3/306 174/120 SR |
| 3,993,531 | A * | 11/1976 | Davila | H01B 13/0883 156/428 |
| 5,099,159 | A * | 3/1992 | Liptak | H02K 3/34 310/45 |
| 2015/0221412 | A1* | 8/2015 | Caudill | H01B 3/427 428/339 |
| 2015/0243410 | A1* | 8/2015 | Knerr | H02K 3/32 310/198 |
| 2018/0005724 | A1* | 1/2018 | Bonnet | C08G 65/4012 |

FOREIGN PATENT DOCUMENTS

| | | | |
|---|---|---|---|
| CN | 104779029 | A | 7/2015 |
| JP | 2004-40044 | A | 2/2004 |

* cited by examiner

*Primary Examiner* — Emmanuel M Marcelo

(74) *Attorney, Agent, or Firm* — Hauptman Ham, LLP

(57) ABSTRACT

In an insulated wire for electromagnetic forming, both of insulation performance and thinning of an insulating member that covers a wire of a coil are realized. A manufacturing method of the insulated wire for electromagnetic forming includes: winding an insulating tape around a wire to insulate the wire by multiple layers of the insulating tape; and winding the insulated wire to form a coil for electromagnetic forming. The insulating tape is wound such that ends of the adjacent insulating tapes on a wire side in a tape width direction do not overlap each other.

9 Claims, 6 Drawing Sheets

MANUFACTURING METHOD OF INSULATED WIRE FOR ELECTROMAGNETIC FORMING

CROSS REFERENCE TO RELATED APPLICATION

This application claims priority to Japanese Patent Application No. 2018-043387 filed on Mar. 9, 2018, which is incorporated herein by reference in its entirety including the specification, claims, drawings, and abstract.

TECHNICAL FIELD

The present disclosure relates to a manufacturing method of an insulated wire for electromagnetic forming and, in particular, to a manufacturing method of an insulated coil wire.

BACKGROUND

An electromagnetic forming technique of installing a coil in a hollow metal member and energizing the coil in a pulse-like manner to increase a diameter of the metal member has been known.

In PATENT DOCUMENT 1, which will be described below, a coil used for electromagnetic forming of a metal member is described. This coil is formed by winding an insulation-coated electrical conductor around an insulating bobbin.

CITATION LIST

Patent Literature

PATENT DOCUMENT 1: JP 2004-040044 A

SUMMARY

In the coil for electromagnetic forming, density of magnetic flux can be increased by increasing the number of windings of the coil. In addition, in the case where the number of windings of the coil is increased and an applied pulse voltage is reduced, there can be realized the same density of the magnetic flux as that in the case before the number of windings of the coil is increased and the applied pulse voltage is reduced. The coil life can be extended by reducing the applied voltage. However, in the case where an insulating member that covers the wire is simply thinned to shorten an interwire distance, so as to increase the number of windings of the coil, insulation performance for the wire is deteriorated.

The present disclosure has a purpose of realizing both of insulation performance and thinning of an insulating member that covers a wire of a coil in an insulated wire for electromagnetic forming.

A manufacturing method of an insulated wire for electromagnetic forming according to the present disclosure includes: winding an insulating tape around a wire to insulate the wire by multiple layers of the insulating tape; and winding the insulated wire to form a coil for electromagnetic forming. The insulating tape is wound such that ends of the adjacent insulating tapes on a wire side in a tape width direction do not overlap each other.

The insulated wire is a wire whose surface has been subjected to insulation processing. In a tape winding process, the insulating tape is wound around a portion to be insulated of the wire, so as to form the multiple layers of the insulating tape. The end of the insulating tape on the wire side in the tape width direction is an end on a side near the wire of two ends of the insulating tape in the tape width direction.

The adjacent insulating tapes are the two insulating tapes, whose tape surfaces at least partially contact each other, in the vicinity thereof. The adjacent insulating tapes may be different portions of a single continuous tape or may be different tapes that are not continuous.

A situation where the ends of the adjacent insulating tapes on the wire side in the tape width direction overlap each other is a situation where the adjacent insulating tapes are wound in such arrangement that the end of one of the insulating tapes on the wire side in the tape width direction overlaps the end of the other insulating tape on the wire side in the tape width direction. In the case where the insulating tapes simply cross each other, it is not said that the tapes overlap each other. In addition, an overlap is a range where it can be regarded that the insulating tapes substantially overlap each other. For example, in the case where the ends of both of the insulating tapes in the tape width direction are arranged within a range of 15% of tape width or smaller, a range of 10% or smaller, or a range of 5% of smaller, it can be regarded that the insulating tapes overlap each other. In this aspect, the insulating tape is wound such that the ends of the adjacent insulating tapes on the wire side in the tape width direction do not overlap each other.

In an aspect of the present disclosure, the insulating tape is wound while a position thereof gradually moves in a wire longitudinal direction such that the number of winding layers becomes the same at each position in a portion to be insulated of the wire.

In the aspect of the present disclosure, when the insulating tape is wound, the two insulating tapes in the same tape width are wound such that the number of the winding layers becomes three at each of the positions in the portion to be insulated of the wire.

As the aspect of the present disclosure, it is possible to realize the insulated wire for electromagnetic forming that includes: the wire, around which the insulating tape is wound; and the coil for electromagnetic forming that is formed by winding the wire. In this insulated wire for electromagnetic forming, the insulating tape is wound such that the ends of the adjacent insulating tapes on the wire side in the tape width direction do not overlap each other.

According to the present disclosure, in the case where the wire is insulated by the insulating tape, provision of a clearance that is associated with winding of the insulating tape is suppressed, and both of insulation performance and thinning of the insulating tape can be realized.

In addition, for example, in the case where the number of the winding layers is the same at each of the positions of the wire, thickness of the insulating tape is uniformized Thus, both of the insulation performance and thinning of the insulating member can be realized.

BRIEF DESCRIPTION OF DRAWINGS

Embodiment(s) of the present disclosure will be described by reference to the following figures, wherein.

DESCRIPTION OF EMBODIMENTS

A description will hereinafter be made on an embodiment with reference to the drawings. Specific aspects will be described to facilitate understanding of the present disclosure. However, each of these aspects merely exemplifies the embodiment, and various other embodiments can also be implemented.

Figure 1:
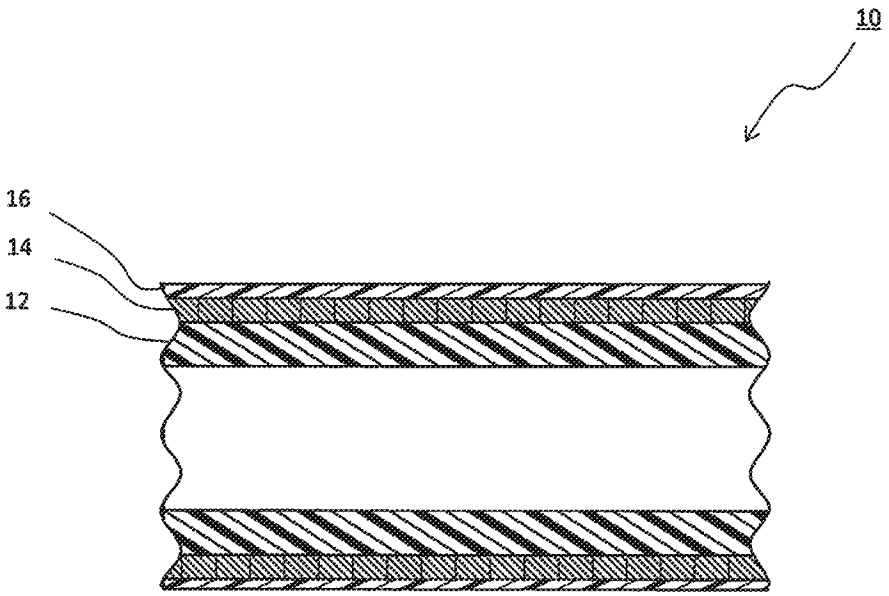
FIG. 1 is a side cross-sectional view of an electromagnetic forming device according to an embodiment.
Figure 2:
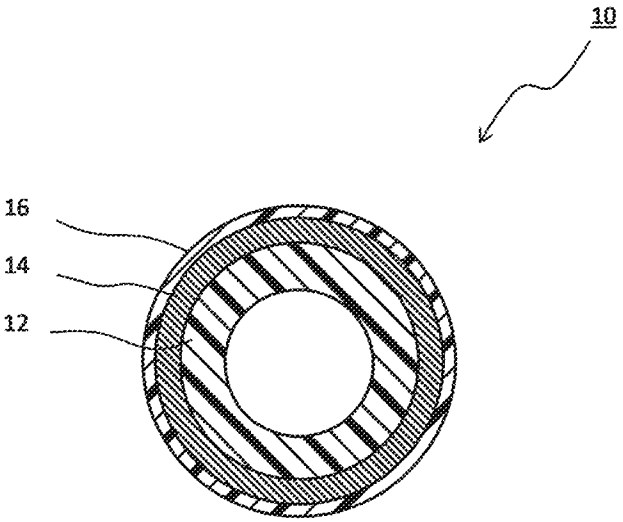
FIG. 2 is a front cross-sectional view of the electromagnetic forming device according to the embodiment.

An electromagnetic forming device according to this embodiment is a device that is formed in a cylindrical shape. FIG. 1 is a side cross-sectional view of an electromagnetic forming device 10, and FIG. 2 is a front cross-sectional view of the electromagnetic forming device 10. In these drawings and the drawing provided thereafter, the same or corresponding components will be denoted by the same reference symbols.

A bobbin 12 that is a hollow cylindrical member is provided on an innermost side of the electromagnetic forming device 10. The bobbin 12 is formed of an insulating member such as a resin. A coil for electromagnetic forming 14 is provided around an outer circumference of the bobbin 12. The coil for electromagnetic forming 14 is formed by winding around the bobbin 12 a wire that has been subjected to insulation processing. An outer side of the coil for electromagnetic forming 14 is covered with an outer insulating tape 16. The outer insulating tape 16 is provided for purposes of protecting the coil for electromagnetic forming 14 and improving insulation performance.

Figure 3:
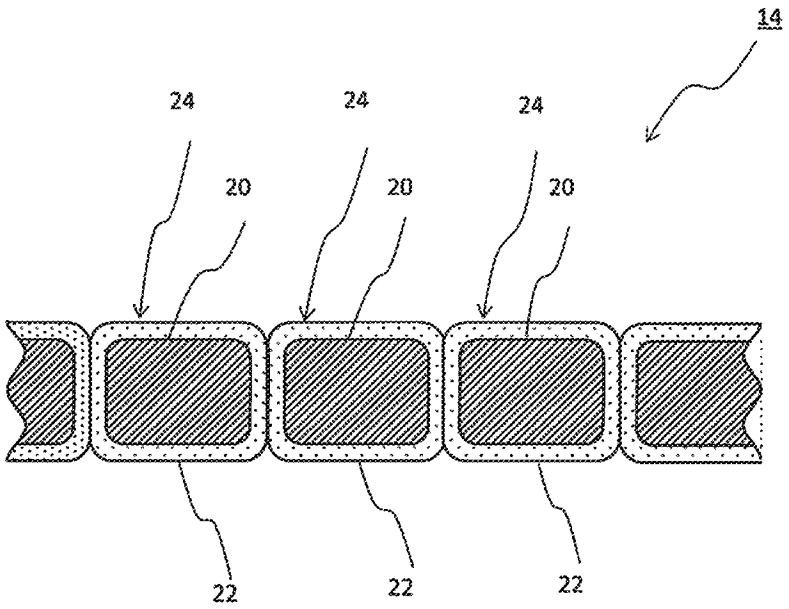
FIG. 3 is a partial cross-sectional view of a coil for electromagnetic forming according to the embodiment.

FIG. 3 is a partially enlarged view of a cross section of the coil for electromagnetic forming 14 shown in FIG. 1. The coil for electromagnetic forming 14 is formed by winding an insulated wire 24 around the bobbin 12, and the insulated wire 24 includes: a wire 20 that is made of an electrically conductive member such as copper; and an inner insulating tape 22 that is wound around the wire 20. The wire 20 is a rectangular wire that is formed to have a substantially rectangular cross-sectional shape, and the insulated wire 24, in which the inner insulating tape 22 is wound around the wire 20, also has a substantially rectangular outer shape. Thus, the juxtaposed insulated wires 24 are wound around the bobbin 12 in a state where outer surfaces thereof closely contact each other. In this way, in the coil for electromagnetic forming 14, density of the insulated wire 24 per unit length is increased.

Figure 4:
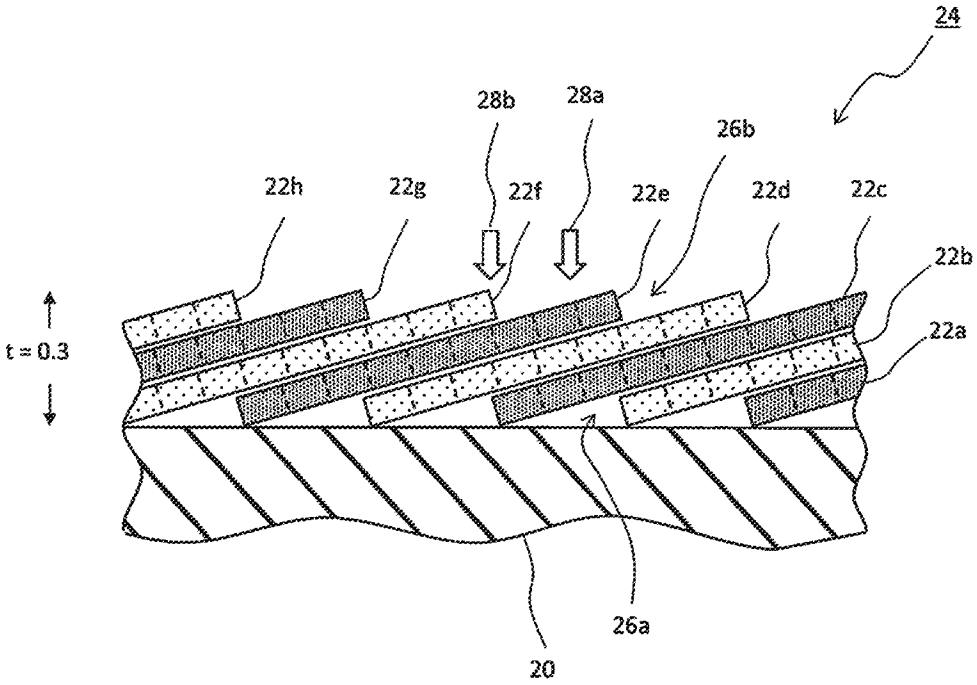
FIG. 4 is a partial cross-sectional view of an insulated wire according to the embodiment.

FIG. 4 is a partial side cross-sectional view of the insulated wire 24. A right-left direction in FIG. 4 corresponds to a wire longitudinal direction of the insulated wire 24, a lower portion of FIG. 4 shows a partial cross section of the wire 20, and an upper portion of FIG. 4 shows a cross section of the inner insulating tape 22 that is wound around the wire 20.

Although no particular limitation is imposed on a material of the inner insulating tape 22, a description will herein be made on the inner insulating tape 22 that is formed by knitting glass fiber or ceramic fiber as an example. Size of the inner insulating tape 22 can be set as desired, and, for example, the inner insulating tape 22 is formed to be about 0.1 mm to 0.3 mm in thickness and about 5 mm to 20 mm in width. The inner insulating tape 22 is wound around the wire 20 while being applied with a tensile force that pulls the inner insulating tape 22 in a tape longitudinal direction.

In the example shown in FIG. 4, two insulating tapes 22 are wound around the wire 20. More specifically, insulating tapes 22*a*, 22*c*, 22*e*, 22*g* shown in a dark color are a single continuous tape and will be referred to as a "dark-colored tape" for convenience of description. Meanwhile, insulating tapes 22*b*, 22*d*, 22*f*, 22*h* shown in a light color are another single continuous tape and will be referred to as a "light-colored tape" for convenience of description.

As described above, each of these insulating tapes 22 is actually formed to be much thinner in a thickness direction than in a width direction. For example, in the case where the thickness is 0.1 mm and the width is 10 mm, a ratio therebetween is 1:100. Accordingly, each of the insulating tapes 22 is thinly wound around a surface of the wire 20 in substantially a parallel state with the surface of the wire 20. It should be noted that the insulating tapes 22 are enlarged in the thickness direction in FIG. 4 for convenience of the description. In addition, because the insulating tapes 22, each of which is made of the fiber, are flexible, each of the insulating tapes 22 can appropriately be deformed and closely contact the adjacent wire 20 or the adjacent inner insulating tape 22. However, in FIG. 4, for convenience of the description, the insulating tapes 22 are drawn to be straight in a tape width direction, and the adjacent insulating tapes 22 are drawn in a manner to be slightly separated from each other. Note that a cross sectional region of each of the insulating tapes 22 is divided into nine blocks by eight chain lines, and these chain lines are provided as auxiliary lines that are used to illustrate a relative positional relationship between the insulating tapes 22.

As shown in FIG. 4, the insulating tapes 22 are wound around the wire 20 while gradually moving in one direction of the wire longitudinal direction. More specifically, the inner insulating tape 22*a* as the dark-colored tape moves towards a left side of the drawing by six-ninths of the tape width (the six blocks of the region that is divided into the nine blocks by the auxiliary lines) while making a single loop, and thereafter becomes the inner insulating tape 22*c*. The inner insulating tape 22*a* further moves towards the left side of the drawing by six-ninths of the tape width while making the additional single loop, and thereafter becomes the inner insulating tape 22*e*. Just as described, the dark-colored tape is wound while moving in the wire longitudinal direction at a constant speed of six-ninths of the tape width per loop.

Similarly, the inner insulating tape 22*b* as the light-colored tape moves towards the left side of the drawing by six-ninths of the tape width while making the single loop, and thereafter becomes the inner insulating tape 22*d*. The inner insulating tape 22*b* further moves towards the left side of the drawing by six-ninths of the tape width while making the additional single loop, and thereafter becomes the inner insulating tape 22*f*. That is, the light-colored tape is wound while moving in the wire longitudinal direction at the same speed as the dark-colored tape.

The dark-colored tape and the light-colored tape that are adjacent to each other are dislocated from each other by three-ninths of the tape width. For example, the inner insulating tape 22*d* as the light-colored tape that is adjacent to an upper side of the inner insulating tape 22*c* as the dark-colored tape is dislocated on an advancing direction side in the wire longitudinal direction from the inner insulating tape 22*c*, by three-ninths of the tape width. In addition, the inner insulating tape 22*e* as the dark-colored tape that is adjacent to an upper side of this inner insulating tape

22*d* is further dislocated on the advancing direction side in the wire longitudinal direction from the inner insulating tape 22*d* by three-ninths of the tape width.

As a result of winding of the two insulating tapes 22 just as described, the insulating tapes 22 as a whole are sequentially wound around the wire 20 at intervals of three-ninths of the tape width. For example, on the upper side of the wound inner insulating tape 22*c*, the inner insulating tape 22*d* is wound in a dislocated manner therefrom on the advancing direction side in the wire longitudinal direction by three-ninths of the tape width. That is, the inner insulating tape 22*d* is arranged such that three-ninths thereof on the advancing direction side contacts the surface of the wire 20 and that sixth-ninths thereof on a reverse side from the advancing direction overlaps sixth-ninths of the adjacent inner insulating tape 22*c* on the advancing direction side that is located on a lower side of the inner insulating tape 22*d*. Similarly, on the upper side of the inner insulating tape 22*d*, the inner insulating tape 22*e* is wound in the dislocated manner therefrom on the advancing direction side in the wire longitudinal direction by three-ninths of the tape width. Furthermore, on an upper side of the inner insulating tape 22*e*, the inner insulating tape 22*f* is wound in the dislocated manner therefrom on the advancing direction side in the wire longitudinal direction by three-ninths of the tape width.

As shown in FIG. 4, triangular clearance spaces are provided between the insulating tapes 22 and the wire 20. For example, a clearance space 26*a* is provided between the inner insulating tape 22*c* and the wire 20. In addition, on outer sides of the insulating tapes 22, clearance spaces resulted from unevenness between the insulating tapes 22 are provided. For example, a clearance space 26*b* is provided between an outer surface of the inner insulating tape 22*d* and an end of the inner insulating tape 22*e* in the tape width direction. Here, since the drawing in FIG. 4 is magnified in a longitudinal direction, and the insulating tapes 22 are flexible as described above, these clearance spaces 26*a*, 26*b* are not significantly large. Actually, the clearance spaces 26*a*, 26*b* are only slightly provided near an end of the inner insulating tape 22*b* on the wire 20 side in the tape width direction and near the end of the inner insulating tape 22*e* on the outer side in the tape width direction, respectively.

Since the insulating tapes 22 are wound as described above, the insulated wire 24 is brought into a state where three layers of the insulating tapes 22 are wound around the wire 20 in an entire circumferential direction at each position of the insulated wire 24 in the wire longitudinal direction. For example, at a position indicated by an arrow 28*a* in FIG. 4, the wire 20 is covered with the three layers of the insulating tapes 22*c*, 22*d*, 22*e*. Accordingly, in the case where thickness of the individual inner insulating tape 22 is set as t=0.1, the three layers have the thickness of t=0.3. Similar to the position indicated by the arrow 28*a*, at most of the positions in the insulated wire 24, the wire 20 is covered with the three layers of the insulating tapes 22.

A situation slightly differs at a position that is indicated by an arrow 28*b* and is located at an end of the inner insulating tape 22 in the tape width direction. At this position, the insulating tapes 22 are in a state where an end of the inner insulating tape 22*c* on the wire 20 side in the tape width direction is located in a lowermost layer, an upper side thereof is covered with the insulating tapes 22*d*, 22*e*, and an end of the inner insulating tape 22*f* on the upper side in the tape width direction is located in an uppermost layer. That is, at the position indicated by the arrow 28*b*, the inner insulating tape 22*c* in the lowermost layer and the inner insulating tape 22*f* in the uppermost layer are arranged at the same position when seen in the wire longitudinal direction (the right-left direction in FIG. 4), and the inner insulating tape 22*c*, which constitutes one of the three layers, is switched to the inner insulating tape 22*f* at this position. In this way, insulation by the three-layered insulating tapes 22 is also secured at the position near the arrow 28*b*.

In general, a slight error occurs when the insulating tapes 22 are wound around the wire 20. A magnitude of the error depends on operation control of a winding device, characteristics of the insulating tapes 22, and the like, and is assumed to be about 15% of the tape width (about 1.5 mm when the tape width is 10 mm), about 10% thereof, or about 5% thereof. Thus, the case where the inner insulating tape 22*c* and the inner insulating tape 22*f* are wound in a slightly separated state when seen in the wire longitudinal direction or the case where the inner insulating tape 22*c* and the inner insulating tape 22*f* are wound in a slightly overlapping state when seen in the wire longitudinal direction is considered.

In the case where the inner insulating tape 22*c* and the inner insulating tape 22*f* are wound in the slightly separated state, the total thickness of the insulating tapes 22 is t=0.3 or t=0.2 at all the positions near the arrow 28*b*. Then, when the multiple insulated wires 24 are juxtaposed to form the coil for electromagnetic forming 14, a portion of the insulated wire 24 with the thickness of t=0.3 is arranged in contact with the adjacent insulated wire 24 with the thickness of t=0.2. Meanwhile, in a portion of the insulated wire 24 with the thickness of t=0.2; that is, in a clearance between the end of the inner insulating tape 22*c* in the tape width direction and the end of the inner insulating tape 22*f* in the tape width direction, the insulation performance that is equivalent to the insulation performance of a periphery of the clearance can be secured. A reason therefor is that, because the power tends to flow along the ends of the insulating tapes 22*c*, 22*f* in the tape width direction in this narrow range, it is considered that a creepage distance is extended. Note that the insulation performance of this clearance may be improved by additional processing such as filling of an additional insulating member in the clearance.

Meanwhile, in the case where the inner insulating tape 22*c* and the inner insulating tape 22*f* slightly overlap each other in the portion near the arrow 28*b* when seen in the wire longitudinal direction, such a portion is covered with the four-layered insulating tapes 22. Thus, the insulation performance of the portion is higher than that of the peripheral portion. However, the thickness of the layers of the insulating tapes 22 is increased in the four-layered portion. Accordingly, in the case where it is desired to prioritize avoidance of the four-layered portion, the inner insulating tape 22*c* and the inner insulating tape 22*f* may be arranged in the manner to be slightly separated from each other so as to prevent the overlap therebetween while the error is taken into consideration. Alternatively, additional processing may be performed after the insulating tapes 22 are wound. In the additional processing, the four-layered portion of the inner insulating tape 22 is scraped to have the thickness of the three layers.

A brief description will herein be made on a mode of a process of winding the inner insulating tape 22 around the wire 20. In this process, the inner insulating tape 22 is fixed to an initial position on the wire 20 by using an adhesive, for example, and the tensile force that pulls the inner insulating tape 22 in the tape longitudinal direction is applied to the inner insulating tape 22. In this state, the inner insulating tape 22 moves in the wire longitudinal direction while the wire 20 rotates. In this way, the inner insulating tape 22 is wound around the wire 20. A winding structure as shown in FIG. 4 can be realized by controlling a moving speed, the tensile force, and the like. In the case where the multiple insulating tapes 22 are used, the wire 20 may be rotated after each of the multiple insulating tapes 22 is set at a specified position and subjected to the tensile force. Since the inner insulating tape 22 is wound with the application of the tensile force, the inner insulating tape 22 strongly tightens the wire 20. Thus, the inner insulating tape 22 does not slide on the wire 20 even when the adhesive or the like is not used. However, it is also possible to increase fixed strength by using the adhesive.

In this way, the insulated wire 24 in which the three-layered inner insulating tape 22 is wound around each of the positions of the wire 20 is formed. Since the thickness of the inner insulating tape 22 is constant at t=0.3 in the insulated wire 24, as shown in FIG. 3, each of the insulated wires 24 can be wound around the bobbin 12 in close contact with the insulated wires 24 on both sides. In this way, in the coil for electromagnetic forming 14 shown in FIG. 1 and FIG. 2, arrangement density of the insulated wire 24 can be increased. In addition, since the wire 20 is covered with the three-layered inner insulating tape 22 on all surfaces of the insulated wire 24, the insulation performance of the insulated wire 24 is improved in comparison with the insulated wire 24 that is insulated by the two-layered inner insulating tape 22, for example. In this way, when the coil for electromagnetic forming 14 is energized, occurrence of insulation breakdown between the closely contacting insulated wires 24 can be suppressed or prevented.

Figure 5:
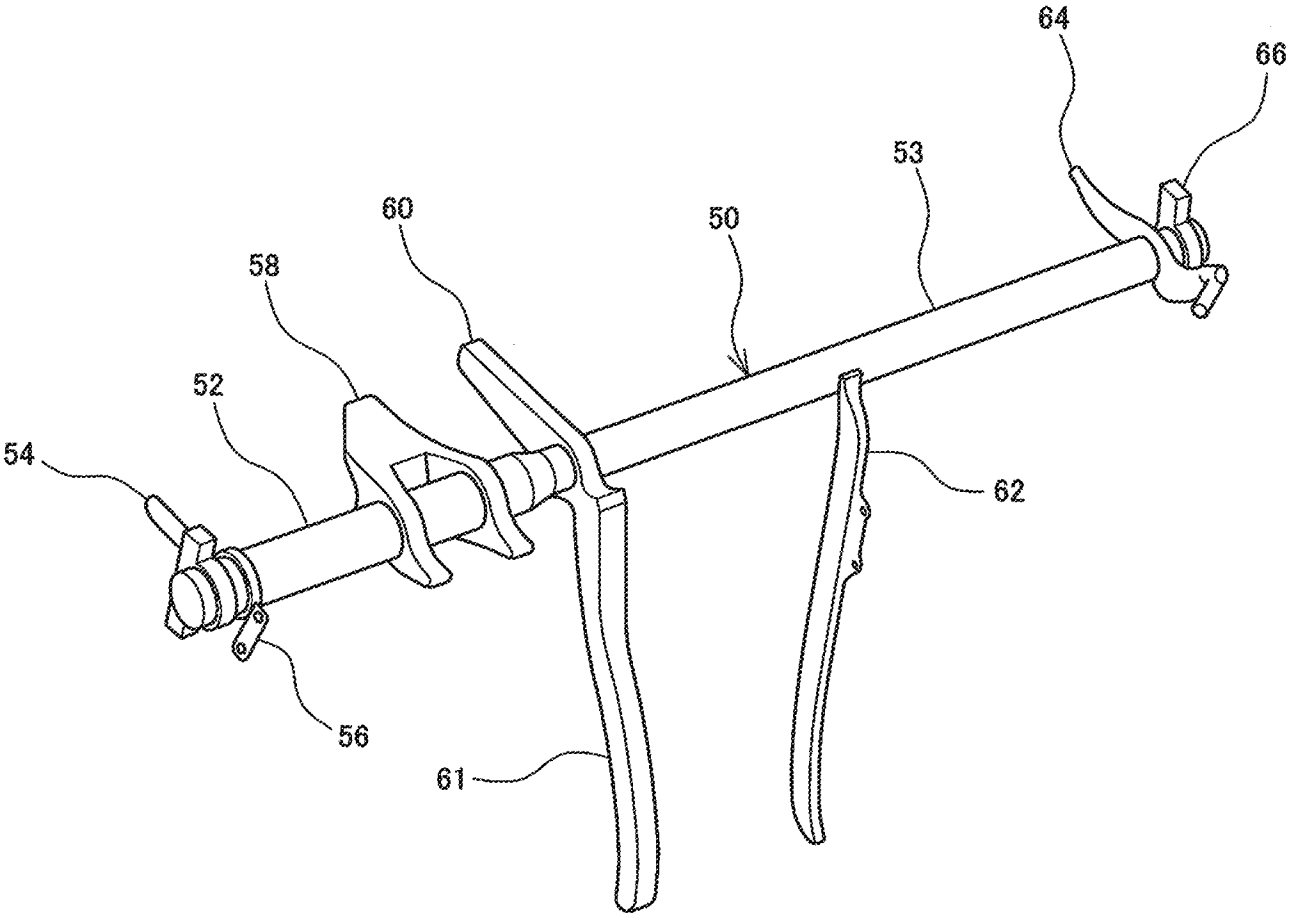
FIG. 5 is a view of an application example of the electromagnetic forming device according to the embodiment.

Next, with reference to FIG. 5 a description will be made on an application example of the electromagnetic forming device 10. FIG. 5 is a view for illustrating a vehicle member that is subjected to electromagnetic forming. FIG. 5 shows an instrument panel reinforcement 50 that is mounted in a vehicle width direction and members attached thereto in a front portion of the vehicle. The instrument panel reinforcement 50 is a cylindrical hollow member that is formed by extrusion molding of an aluminum alloy, and includes: a D-seat pipe 52 that is located on a driver seat side and has a relatively large diameter; and a P-seat pipe 53 that is located on a passenger seat side and has a relatively small diameter. A D-seat extension 54 is attached to an end of the D-seat pipe 52, and a mounting bracket LH 56 is attached to a portion of the D-seat pipe 52 on an inner side of the D-seat extension 54. Furthermore, a steering wheel support member 58 that is used to support a steering wheel is attached to a portion of the D-seat pipe 52 on the inner side of the mounting bracket LH 56. A maneuverability stabilizing brace 60 and a D-seat brace 61 are integrally attached to a portion of the P-seat pipe 53 near the driver seat. A P-seat brace 62 is attached to a portion of the P-seat pipe 53 near the passenger seat. A mounting bracket RH 64 and a P-seat extension 66 are attached to an end of the P-seat pipe 53 on the passenger seat side.

In the example shown in FIG. 5, of these members, the D-seat extension 54, the mounting bracket LH 56, the steering wheel support member 58, the maneuverability stabilizing brace 60 and the D-seat brace 61, the mounting bracket RH 64, and the P-seat extension 66 as fixed members are caulked and fixed to the instrument panel reinforcement 50 by electromagnetic forming.

For fixation and caulking by electromagnetic forming, these fixed members are arranged around the instrument panel reinforcement 50, and the electromagnetic forming device 10 is installed in the instrument panel reinforcement 50. The coil for electromagnetic forming 14 is energized in a pulse-like manner (a large current flows therethrough in a short time). At this time, magnetic flux is generated in the coil for electromagnetic forming 14, and the magnetic flux induces an electrical current in the instrument panel reinforcement 50. An electromagnetic force acts between the induced current and the magnetic flux. As a result, a wall surface of the instrument panel reinforcement 50 that opposes the coil for electromagnetic forming 14 receives a significant amount of force, and a diameter of the instrument panel reinforcement 50 is increased in a short time. Thereafter, the fixed members that are arranged in the vicinity of the wall surface of the instrument panel reinforcement 50 are caulked and fixed thereto.

The amount of the force that increases the diameter of the instrument panel reinforcement 50 by electromagnetic forming is increased in accordance with density of the magnetic flux generated from the coil for electromagnetic forming 14. In addition, density of the magnetic flux is increased by arranging the wire 20 densely. Accordingly, in the case where a magnitude of a voltage that is applied to the wire 20 is the same, the diameter of the instrument panel reinforcement 50 can be further increased when the wire 20 is arranged densely. In addition, in the case where the wire 20 is arranged densely, the diameter of the instrument panel reinforcement 50 can be increased by the force, whose magnitude is substantially the same as that in the case where the wire 20 is arranged sparsely, even when the voltage that is applied to the wire 20 is reduced. In general, in the case where the voltage that is applied to the wire 20 is reduced, deterioration of the coil for electromagnetic forming 14 is suppressed, and thus life of the coil for electromagnetic forming 14 can be extended. In addition, due to the above reason, the instrument panel reinforcement 50 can be manufactured efficiently.

Figure 6:
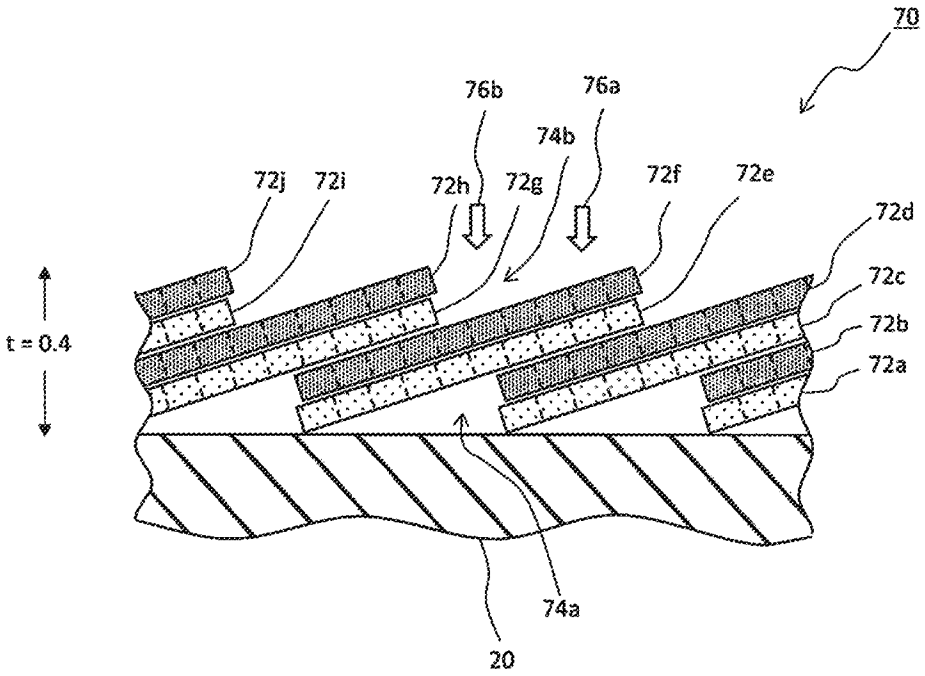
FIG. 6 is a partial cross-sectional view of an insulated wire according to a reference example.

With reference to FIG. 6, a description will herein be made on a reference example for a comparison. FIG. 6 is a view that corresponds to FIG. 4, and shows a partial cross section of an insulated wire 70 in which the wire 20 is subjected to the insulation processing. Also, in the example shown in FIG. 6, two dark-colored and light-colored insulating tapes 72 that are made of a similar material and have similar size to those in the example shown in FIG. 4 are employed. However, in the example shown in FIG. 6, a winding mode of the insulating tapes 72 differs. In view of the above, in the example shown in FIG. 6, a description will be made by drawing nine auxiliary lines on cross sections of the insulating tapes 72 (in this way, a cross sectional region of each of the insulating tapes 72 is divided into ten blocks).

In the reference example shown in FIG. 6, light-colored insulating tapes 72*a*, 72*c*, 72*e*, 72*g*, 72*i* are wound such that the insulating tape 72 advances in one direction (the left direction in the drawing) of the wire longitudinal direction by six-tenths of tape width every time the insulating tape 72 is wound to make a loop. Dark-colored insulating tapes 72*b*, 72*d*, 72*f*, 72*h*, 72*j* are then wound in a manner to overlap outer sides of the light-colored insulating tapes 72*a*, 72*c*, 72*e*, 72*g*, 72*i* (a direction that perpendicularly extends outward from the surface of the wire 20), respectively.

More specifically, the dark-colored insulating tape 72*d* is wound on the outer side of the light-colored insulating tape 72*c* in a manner to overlap therewith for substantially the entire tape width. After making the single loop, the light-colored insulating tape 72*e* is wound such that six-tenths of the tape width thereof directly contacts the wire 20 and that four-tenths of the tape width thereof overlaps the dark-colored insulating tape 72*d*. In addition, the dark-colored insulating tape 72*f* is wound on the outer side of the light-colored insulating tape 72*e* in a manner to overlap the light-colored insulating tape 72*e* for the entire tape width.

Accordingly, in the reference example shown in FIG. 6, a clearance space, whose size corresponds to the thickness of the two layers, is provided between the light-colored insulating tape 72 and the wire 20. More specifically, under the insulating tape 72*e*, a clearance space 74*a* is provided in the vicinity of ends of the insulating tapes 72*c*, 72*d* on the wire 20 side in the tape width direction. In addition, on an outer surface side of the dark-colored insulating tape 72, the clearance space is formed in the vicinity of ends of the insulating tapes 72, which partially overlap each other, in the tape width direction. For example, on the outer surface side of the insulating tape 72*f*, a clearance space 74*b* is provided in the vicinity of ends of the insulating tapes 72*g*, 72*h* in the tape width direction.

As a result of winding the insulating tapes 72 just as above, thickness of the insulating tapes 72 differs by positions of the insulated wire 70 in the wire longitudinal direction. For example, at the position near an arrow 76*a*, the insulating tapes 72*c*, 72*d*, 72*e*, 72*f* overlap each other to form four layers. Meanwhile, at the position near an arrow 76*b*, the insulating tapes 72*e*, 72*f* overlap each other to only form two layers. That is, in the insulated wire 70, a portion where the thickness of the insulating tapes 72 is t=0.4 and a portion where the thickness of the insulating tapes 72 is t=0.2 coexist.

In the case where the coil for electromagnetic forming 14 is formed by using the insulated wire 70, a distance between the adjacent insulated wires 70 is determined by a portion of each of the insulated wires 70 in thickness of t=0.4. Accordingly, compared to the case where the insulated wire 24 shown in FIG. 4 is used, the density of the wire 20 is reduced. In addition, in the insulated wire 70, a portion where the insulating tapes 72 form the two layers and that has the thickness of t=0.2 occupies a significantly large area. When the electric current flows through such a portion, dielectric breakdown occurs relatively easily. The dielectric breakdown is generally initiated when a weak corona discharge occurs in a portion where the insulation performance is the poorest. Then, the dielectric breakdown gradually leads to a high-voltage spark, which further generates an arc discharge by which the large electric current flows through the portion. As a result, the wire 20 is melted and ruptured, or the like.

As has been described so far, the electromagnetic forming device 10 according to this embodiment differs from the case in the reference example shown in FIG. 6 and can uniformly cover the wire 20 with the insulating tapes 22. In this way, the portion where the insulation performance is the poorest is not formed, and the high insulation performance can be secured for the entire insulating tapes 22. In addition, when the entire insulating tapes 22 are thinned, current density and further the density of the magnetic flux of the coil for electromagnetic forming 14 can be increased. Thus, electromagnetic forming can be performed at the low applied voltage. This is effective in terms of prevention or suppression of the deterioration of the coil for electromagnetic forming 14.

In the description that has been made so far, in the electromagnetic forming device 10 according to this embodiment, the two insulating tapes 22 of the same width are wound around the wire 20 in the insulated wire 24. However, even when the single inner insulating tape 22 is used, winding as shown in FIG. 4 can be realized. In this case, the inner insulating tape 22 only has to be wound at the slow moving speed in the wire longitudinal direction, for example. Alternatively, winding as shown in FIG. 4 can also be realized by using the three or more insulating tapes 22. In this case, consideration is given to increasing the moving speed of each of the insulating tapes 22 in the wire longitudinal direction when the insulating tapes 22 are wound, for example.

The example in which the insulated wire 24 is insulated by the three-layered insulating tapes 22 has been described so far. However, the insulating tapes 22 can be provided in the two layers, four layers, five layers, or more. The number of the winding layers only has to be determined in consideration of securement of the insulation performance and necessity of thinning.

Instead of being the rectangular wire, the wire 20 may be in another cross-sectional shape such as a circular wire. The insulating tapes 22 can be wound irrespective of the cross-sectional shape of the wire 20.

REFERENCE SIGNS LIST

10: Electromagnetic forming device
12: Bobbin
14: Coil for electromagnetic forming
16, 22, 72: Insulating tape
20: Wire
24, 70: Insulated wire
26*a*, 26*b*, 74*a*, 74*b*: Clearance space
28*a*, 28*b*, 76*a*, 76*b*: Arrow
50: Instrument panel reinforcement
52: D-seat pipe
53: P-seat pipe
54: D-seat extension
56: Mounting bracket LH
58: Steering wheel support member
60: Maneuverability stabilizing brace
61: D-seat brace
62: P-seat brace
64: Mounting bracket RH
66: P-seat extension

The invention claimed is:

1. A manufacturing method of an insulated wire for electromagnetic forming, the manufacturing method comprising:

winding an insulating tape around a wire to insulate the wire by a plurality of layers of the insulating tape; and winding the insulated wire to form a coil for electromagnetic forming, wherein the insulating tape is wound such that ends of the adjacent insulating tapes on a wire side in a tape width direction do not overlap each other.

2. The manufacturing method of an insulated wire for electromagnetic forming according to claim 1, wherein the insulating tape is wound while a position thereof gradually moves in a wire longitudinal direction such that the number of winding layers becomes the same at each position in a portion to be insulated of the wire.

3. The manufacturing method of an insulated wire for electromagnetic forming according to claim 2, wherein when winding plurality insulating tapes, two insulating tapes of the plurality of insulating tapes having a same tape width are wound such that the number of the winding layers becomes three at each of the positions in the portion to be insulated of the wire.

4. The manufacturing method of an insulated wire for electromagnetic forming according to claim 3, wherein winding the plurality of insulating tapes comprises winding the two insulating tapes to define an alternating pattern on the wire.

5. The manufacturing method of an insulated wire for electromagnetic forming according to claim 2, wherein when winding plurality insulating tapes, two insulating tapes of the plurality of insulating tapes having a same tape width are wound such that the number of the winding layers becomes four at each of the positions in the portion to be insulated of the wire.

6. The manufacturing method of an insulated wire for electromagnetic forming according to claim 1, further comprising moving the wire during the winding the insulating tape.

7. The manufacturing method of an insulated wire for electromagnetic forming according to claim 6, wherein moving the wire comprises moving the wire six-ninths of a width of the insulating tape for each winding around the wire.

8. The manufacturing method of an insulated wire for electromagnetic forming according to claim 1, wherein the insulating tape has a thickness ranging from 0.1 mm to 0.3 mm.

9. The manufacturing method of an insulated wire for electromagnetic forming according to claim 1, wherein the insulating tape has a width ranging from 5 mm to 20 mm.

* * * * *